United States Patent [19]

Branovich et al.

[11] Patent Number: 5,074,818

[45] Date of Patent: Dec. 24, 1991

[54] METHOD OF MAKING AND IMPROVED SCANDATE CATHODE

[75] Inventors: Louis E. Branovich, Howell; Donald W. Eckart, Wall; Gerard L. Freeman, Freehold; Bernard Sith, Ocean, all of N.J.

[73] Assignee: The United States of America as represented by the Secretary of the Army, Washington, D.C.

[21] Appl. No.: 688,405

[22] Filed: Apr. 22, 1991

[51] Int. Cl.[5] ..... H01J 19/06

[52] U.S. Cl. ..... 445/51; 313/346 DC

[58] Field of Search ..... 445/51, 50; 313/346 DC

[56] References Cited

U.S. PATENT DOCUMENTS

| | | | |
|---|---|---|---|
| 4,052,634 | 10/1977 | De Kok | 445/51 |
| 4,518,890 | 5/1985 | Taguchi et al. | 313/346 DC |
| 5,022,883 | 6/1991 | Branovich et al. | 313/346 DC |
| 5,041,757 | 8/1991 | Longo et al. | 313/346 DC |

FOREIGN PATENT DOCUMENTS

| | | | |
|---|---|---|---|
| 774046 | 5/1957 | United Kingdom | 445/51 |

*Primary Examiner*—Richard K. Seidel
*Assistant Examiner*—Jeffrey T. Knapp
*Attorney, Agent, or Firm*—Michael Zelenka; Roy E. Gordon

[57] ABSTRACT

An improved scandate cathode is made from a hollow cylinder of a metal that will not react with $Sc_2(WO_4)_3$. The first step in making such a cathode is to insert a metal plug at the bottom of the cylinder to a height that will allow the remaining volume of the cylinder to be filled with the reactants $WO_3$ and $Sc_2O_3$. Next, the reactants are heated in a vacuum to about 1100° C. to form the reaction product $Sc_2(WO_4)_3$. The plug is then removed from the cylinder, the cylinder is inverted, and $BaH_2$ is added to the volume of the cylinder that had been occupied by the plug. Finally, the cylinder is heated to decompose the $BaH_2$.

3 Claims, No Drawings

METHOD OF MAKING AND IMPROVED SCANDATE CATHODE

GOVERNMENT INTEREST The invention described herein may be manufactured, used, and licensed by or for the Government for governmental purposes without the payment to us of any royalty thereon.

FIELD OF INVENTION

This invention relates in general to a method of making a high current density long life cathode and in particular to a method of making an improved long life, high current density scandate cathode.

BACKGROUND OF THE INVENTION

Heretofore, high current density, long life scandate cathodes have generally been prepared by impregnating a porous tungsten billet with an impregnant such as $Ba_3Al_2O_6$ followed by a layer of $Sc_2(WO_4)_3$ deposited on the top of the impregnated billet. This has been done by mixing 1 mole of $Sc_2O_3$ with 3 moles of $WO_3$ to yield $Sc_2(WO_4)_3$.

The foregoing method is not altogether satisfactory in that the generation of free barium for emission is limited to the amount of impregnant in the porous tungsten billet. This gives the cathode a limited life.

SUMMARY OF THE INVENTION

The general object of this invention is to provide a method of making an improved long life, high current density scandate cathode. A more particular object of this invention is to provide such a method in which the amount of barium generated is not dependent on the porosity of a tungsten billet.

It has now been found that the aforementioned objects can be attained by a method of making an improved scandate cathode from a hollow cylinder of a metal that will not react with $Sc_2(WO_4)_3$, said method including the steps of:

(A) Inserting a metal plug at the bottom of the hollow cylinder to a height that will allow the remaining volume of the cylinder to be filled with the reactants $WO_3$ and $Sc_2O_3$, (B) Heating the reactants $WO_3$ and $Sc_2O_3$ in vacuum to about 1100° C. to form the product $Sc_2(WO_4)_3$, (C) Removing the plug from the cylinder, inverting the cylinder and adding $BaH_2$ to the volume of the cylinder that had been occupied by the plug, and (D) Heating the cylinder to decompose the $BaH_2$.

As the hollow cylinder, one uses a metal such as molybdenum. The metal plug should be of the same material as the hollow cylinder.

The invention is believed to work because more free barium is available to react with the scandium tungstate. This enhances the life of the scandate cathode and gives a high current density at the same temperature as compared to a standard scandate cathode.

DESCRIPTION OF THE PREFERRED EMBODIMENT

A hollow cylinder made of molybdenum metal having an inside diameter of 0.14 inch and a surface area of 0.1 $cm^2$ is prepared. A plug made of molybdenum is inserted at the bottom of the hollow cylinder to a height of 0.030 inch. The remaining volume of the cylinder that is about 0.120 inch is filled with the reactants $WO_3$ and $Sc_2O_3$. The reactants $WO_3$ and $Sc_2O_3$ are heated to about 1100° C. to form the reaction product $Sc_2(WO_4)_3$.

The plug is removed from the cylinder, the cylinder inverted, and 0.085 inch of $BaH_2$ added to the volume of the cylinder that was occupied by the plug. The cylinder is then heated to decompose the $BaH_2$.

We wish it to be understood that we do not desire to be limited to the exact details of construction shown and described for obvious modifications will occur to a person skilled in the art.

What is claimed is:

1. Method of making an improved scandate cathode from a hollow cylinder of a metal that will not react with $Sc_2(WO_4)_3$ said method including the steps of:

(A) inserting a metal plug at the bottom of the hollow cylinder to a height that will allow the remaining volume of the cylinder to be filled with the reactants $WO_3$ and $Sc_2O_3$, (B) heating the reactants in a vacuum to about 1100° C. to form the reaction product $Sc_2(WO_4)_3$, (C) removing the plug from the cylinder, inverting the cylinder and adding $BaH_2$ to the volume of the cylinder that had been occupied by the plug, and (D) heating the cylinder to decompose the $BaH_2$.

2. Method according to claim 1 wherein the hollow cylinder is made of the same metal as the metal plug.

3. Method according to claim 2 wherein the hollow cylinder and the metal plug are made of molybdenum.

* * * * *